US007188873B2

(12) United States Patent
Brown et al.

(10) Patent No.: US 7,188,873 B2
(45) Date of Patent: Mar. 13, 2007

(54) DOOR HANDLE SYSTEM

(75) Inventors: Gerald L. Brown, Logan, UT (US); Timothy V. George, Smithfield, UT (US)

(73) Assignee: Stone River Bronze, LLC, Logan, UT (US)

( * ) Notice: Subject to any disclaimer, the term of this patent is extended or adjusted under 35 U.S.C. 154(b) by 216 days.

(21) Appl. No.: 10/651,163

(22) Filed: Aug. 27, 2003

(65) Prior Publication Data

US 2005/0044666 A1 Mar. 3, 2005

(51) Int. Cl.
*E05B 3/00* (2006.01)

(52) U.S. Cl. ..... 292/336.3; 292/348

(58) Field of Classification Search ..... 292/348, 292/336.3, 350, 351, 356, 357, DIG. 53, 292/DIG. 64
See application file for complete search history.

(56) References Cited

U.S. PATENT DOCUMENTS 1,611,999 A * 12/1926 Cummins ..... 292/356
1,787,707 A * 1/1931 Sullivan ..... 292/348
4,202,575 A * 5/1980 Bates ..... 292/347
4,343,502 A 8/1982 Nelson
4,569,547 A 2/1986 Fayerman et al.
4,784,418 A * 11/1988 Pearson et al. ..... 292/348
5,067,758 A * 11/1991 Fann et al. ..... 292/347
5,481,890 A * 1/1996 Millman ..... 70/224
5,752,399 A 5/1998 Shen
5,787,743 A 8/1998 Weigard
6,532,629 B2 3/2003 Armstrong
6,533,336 B2 3/2003 Kemp et al.

* cited by examiner

*Primary Examiner*—Gary Estremsky
(74) *Attorney, Agent, or Firm*—Reinhart Boerner Van Deuren s.c.

(57) ABSTRACT

A convertible door handle system that can be converted for a different handing or operating direction, or converted between handle-high and handle low, or converted between operating and non-operating is disclosed. A method for converting the functional configuration of a door handle system is also disclosed.

30 Claims, 3 Drawing Sheets

DOOR HANDLE SYSTEM

FIELD OF THE INVENTION

The present invention relates generally to door handle systems and related assemblies.

BACKGROUND

Door handle systems may be configured in a myriad of ways. First, handing is often used to refer to the side of the door on which the handle is located. Handing, however, is relative to whether specified from the interior or exterior. A left-handed interior door handle system can also be referred to as right-handed exterior. Second, operating handles and deadbolt locks are often included together in a door handle assembly. Accordingly, the handle may be positioned either above or below the deadbolt, which is referred to as handle-high or handle-low, respectively. This may be referred to as the orientation of the door handle assembly. Third, in double doors (e.g. a French door) the functionality of the handles on each door is often different. One handle may be operating and the other handle may be non-operating (a "dummy" handle). Alternately, one handle may operate an internal door latch or lock, and the handle may operate shoot bolts at the head and foot of the door. Operation of the handle may be active in either an up direction, a down direction, both, or operate differently in the up and down direction. For example, double door systems are sometimes configured so that one door handle operates the door latch and/or lock when rotated down and the other door handle operates the shoot bolts by retracting the shoot bolts when rotated down and extending and locking the shoot bolts when rotated up. Finally, some door handle systems are configured so that the door handle is operating from one side, but non-operating from the other.

With the variety of possible door handle configurations and door handing configurations, confusion in product ordering is possible, and door handle systems and assemblies are often ordered in a wrong functional configuration. To further compound the difficulties, customers sometimes request a configuration change for the door and/or door handle system after viewing the installation.

These difficulties have been further compounded by the increasing popularity of lever style handles. Because lever style handles are asymmetric, configuring the handing of the door correctly is even more important. Furthermore, the off-axis weight of lever handles places greater demands on the construction of the door handle system to avoid the appearance of low quality. Customers object to handle sag and wobble. Handle sag is where the handle does not rest at a level position. Wobble can be generally defined as where the handle is loose or rattles in the door handle assembly. Prior approaches to eliminating handle wobble have included techniques such as assembling the door handle assembly using one way push nuts and glue, permanently damaging threads during assembly, or applying Loctite® (glue type solutions) to the threads within the assembly to avoid the loosening of the components. Non-operating handles have sometimes been welded in place or have used a recessed facebore dummy spindle mount. These approaches, however, compound the difficulty of reconfiguring a door at the installation location, since disassembly of the door handle system typically results in the destruction of one or more components.

Known door handle systems may be also susceptible to overdrive. When the handle is rotated too far, or overdriven, this causes bending of parts or weakening of springs used to restore the handle to a normal resting position.

Traditionally, door handle systems have been constructed of lacquered brass, which is susceptible to corrosion and scratching, further contributing to an appearance of low quality. Customers desire to have both high quality door handle systems and lock or latch components and the appearance of high quality.

SUMMARY OF THE INVENTION

The invention includes a convertible door handle system. In one embodiment, the convertible door handle system includes a receiver plate, a handle inserted through an opening in the receiver plate, a drive assembly positioned within a recess in the receiver plate, and a removable locking fastener securing the handle and drive assembly within the receiver plate.

In a non-operating embodiment, the convertible door handle system includes a receiver plate, a handle inserted through an opening in the receiver plate, a dummy lug positioned within a recess in the receiver plate holding the handle in a fixed position, and a fastener securing the handle and dummy lug within the receiver plate.

The invention further includes a method of converting a functional configuration of a door handle system. The method includes disassembling the door handle system by removing a removable locking fastener from the door handle system, reconfiguring at least one component of the door handle system to change the functional configuration, and reinstalling the removable locking fastener onto the door handle system.

Additional features and advantages of the invention will be apparent from the detailed description which follows, taken in conjunction with the accompanying drawings, which together illustrate, by way of example, features of the invention.

DETAILED DESCRIPTION

Figure 1:
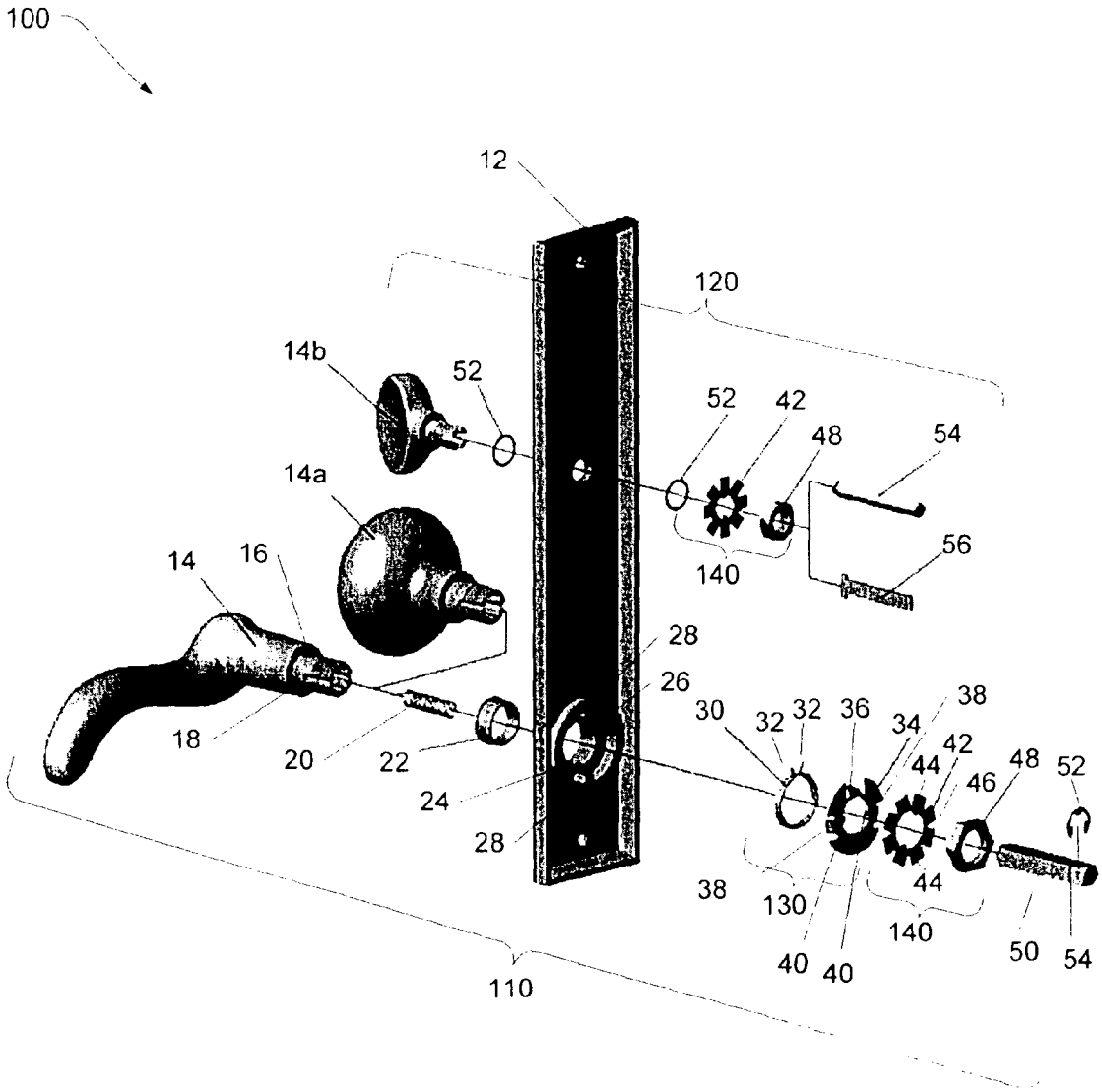
FIG. 1 is an exploded view of a convertible door handle system in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It has been recognized that there is a need for a high-quality door handle system that may be converted to accommodate changes in handing, orientation, and function. A convertible door handle system has been developed as illustrated in FIG. 1, indicated generally at 100, in accordance with the present invention. The embodiment of the door handle system illustrated in FIG. 1 includes an operating door handle assembly 110 and a deadbolt assembly 120 used with a receiver plate 12. The receiver plate shown in FIG. 1 is in the form of an escutcheon plate, but the receiver plate is not limited to this form. The receiver plate or escutcheon plate can be implemented as an single component or as separate components. For example, the receiver plate can snap into an escutcheon plate or the receiver plate can be placed between an escutcheon plate and a door surface, in order to hide the receiver plate behind an escutcheon plate. Various other arrangements of the receiver plate within a door handle assembly may be devised by one of skill in the art.

The operating door handle assembly 110 includes a handle 14. As shown, the handle is in the form of a lever handle, but a doorknob 14*a* can also be used. The handle is inserted through a receiver hole 26 in the receiver plate 12. The handle receives a spindle 50, which is inserted into a handle shaft 16 and the spindle drives the internal latch or lock mechanisms of the door. In one embodiment, the handle shaft may be bored and star broached with an 8 millimeter square and a 7.3 millimeter diamond to accommodate multiple types of spindles. The spindle can be a half spindle or a full spindle. A spindle spring 20 accommodates slight variations in the manufacturing width of the door or environmental conditions that cause the door to shrink or swell and applies positive pressure on the spindle to the lock and/or latch hub interface. A clip 52 may be used to ensure that the force from spindle spring 20 does not push the spindle too far into the lock and/or latch mechanism. Clip 52 may bear against a groove 54 in the spindle. Rotation of the handle rotates the spindle, and operates the internal latch or lock mechanism of the door. As various internal latch and lock mechanisms are well known in the art, the details are not provided here.

A bushing 22 may optionally be placed within the receiver hole 26 to provide a bearing surface for the handle 14. Although the bushing may be fabricated of a variety of materials, a plastic is advantageous, for example, Deirin®. By maintaining tight tolerances on the bushing inner and outer diameter relative to the handle shaft 16 and receiver hole 26 dimensions, wobble in the door handle assembly can be minimized.

The handle 14 is secured in the receiver plate 12 by a drive assembly 130 and a removable locking fastener 140. The drive assembly slides over the handle shaft 16 and rests in the receiver recess 24 to rotatably couple the handle with the receiver plate 12. The drive assembly permits rotation of the handle and applies restoring force to restore the handle to a desired rotational position.

A handle index and a receiver index can provide reference points for the drive assembly to define the desired rotational position. The receiver index may be implemented in the form of a receiver nub 28, and the handle index can be implemented in the form of a handle groove 18. When a handle groove is used, it is beneficial that the handle groove does not extend entirely into the bored and broached handle shaft 16, since this might permit the handle shaft to collapse when the removable locking fastener 140 is installed, which can make insertion and removal of the spindle 50 difficult.

Alternately, the handle index may be implemented as a ridge, rather than a groove, and the drive assembly may include a cutout, rather than a nub, to engage the groove. In general, any index may be implemented as a nub, a tab, a cutout, a groove, or a similar reference point defining structure, as may occur to one of skill in the art.

The drive assembly 130 may include a coil spring 30 and a drive washer 34. The drive washer includes nubs 40, which engage the handle grooves 18 to rotationally lock the drive washer to the handle. The coil spring has two ears 32. One ear bears against a drive washer tab 36 and the other ear bears against the receiver nub 28 when the handle is rotated. The coil spring provides resistance to rotation of the handle 14, and applies force to restore the handle to the desired substantially level position. The coil spring can be selected in accordance with the off-axis weight of the handle to eliminate handle sag. Generally speaking, a stiffer coil spring can be used for more unbalanced handles. The latch and/or lock provides the primary force to return the handle to the resting position, while the coil spring helps eliminate the unsightly handle sag. In one embodiment of the invention, the coil spring is a double coil.

Additional drive washer tabs 38 can be included to prevent overdrive of the handle 14. The additional drive washer tabs may contact a second receiver nub 28 to limit rotation of the handle. By providing drive washer tabs symmetrically located on each side of the drive washer, overdrive is prevented in either direction of operation. Preventing overdrive in both directions is helpful where the operating direction of the handle is converted. Additional drive washer tabs can also be included to limit rotation of the handle to a single direction. By providing receiver nubs symmetrically located about the receiver recess the drive assembly may be reoriented to change the door handle system orientation (e.g. from turning the handle clockwise to rotating the handle counterclockwise to operate the door handle).

In general, by providing symmetrically located indices within the door handle system, reconfiguration of the door handle system is enhanced. For example, by providing receiver nubs 28 symmetrically located on the top and bottom of the receiver plate 12, the receiver plate may be reconfigured to change the door handle system orientation (e.g. from handle-high to handle-low) without replacing any components. Similarly, by providing two handle grooves 18 symmetrically located on each side of the handle shaft 16 and corresponding drive washer nubs 40, the handing of the door handle system may be changed by replacing the handle 14 without the need to replace any other components.

The removable locking fastener 140 secures the handle and drive assembly within the receiver plate 12. The removable locking fastener may include a nut 48 and retainer. The retainer is illustrated here in the form of a star washer 42. The nut is threaded onto the handle shaft 16. The star washer can include nubs 44 which engage the handle groove 18. The star washer tabs 46 may be bent up against the side of the nut to prevent the nut from turning on the handle shaft. The removable locking fastener can then be removed by unbending the star washer tabs and unthreading the nut. Because the removable locking fastener may be removed without damaging any components of the convertible door handle system 100, the operating door handle assembly 110 may be disassembled to reconfigure the system.

A deadbolt assembly 120 operates using inventive concepts similar to those described above. A deadbolt turnpiece 14*b* is inserted through the receiver plate, and held in place using a removable locking fastener 140. The deadbolt turnpiece is connected to the internal deadbolt mechanism by a connecting rod or device, which may be either a deadbolt spindle 54 or a deadbolt flat tailpiece 56, depending on the type of the deadbolt mechanism. The details of various deadbolt mechanisms are well known and hence are not illustrated here. Optionally, washers 52 may be placed either side of the receiver plate to provide a bearing surface for the deadbolt turnpiece and removable locking fastener and to minimize wobble.

By using a removable locking fastener, the deadbolt assembly 120 may be disassembled and reconfigured, for example to replace the deadbolt turnpiece 14*b*, the deadbolt spindle 54 or the deadbolt tailpiece 56. For example, the deadbolt spindles and deadbolt tailpieces, whether flat or spindle, are typically manufactured to be longer than needed, and then cut during installation to match the correct thickness of the door. If the deadbolt spindle or deadbolt tailpiece is cut too short, a replacement can easily be installed. Prior art assemblies have used one-way push nuts or other relatively permanent fasteners which can not easily be disassembled.

Figure 2:
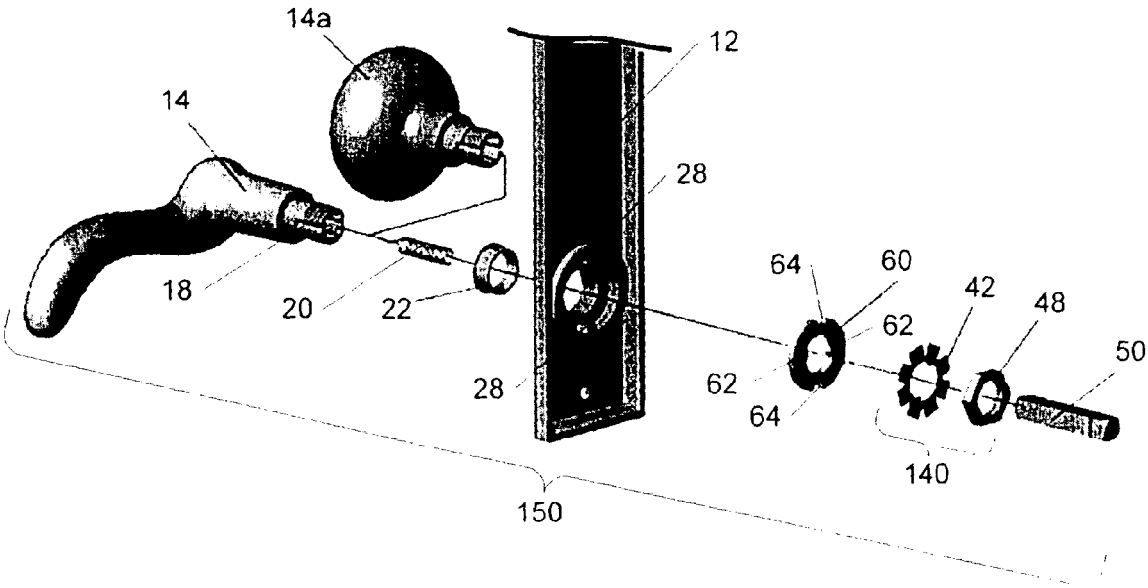
FIG. 2 is an exploded view of a convertible door handle system in accordance with another embodiment of the present invention.

Another embodiment of a convertible door handle system is illustrated in FIG. 2, in accordance with the present invention. A portion of the receiver plate 12 is shown with a non-operating door handle assembly 150. A handle 14 is inserted through the receiver plate 12 and held in place with a removable locking fastener 140. A dummy lug 60 holds the handle in a fixed position by engaging with the receiver index 28 and handle index 18. For example, the dummy lug may include dummy cutouts 64 which engage the receiver nubs 28 and may include dummy nubs 62 which engage the handle grooves 18. Although a spindle spring 20 and spindle 50 are shown, these components may be omitted from the non-operating door handle assembly.

The dummy lug 60 and the drive assembly 130 (FIG. 1) are interchangeable, which enables conversion of a door handle assembly from operating to non-operating or vice versa. For example, the operating door handle assembly 110 (FIG. 1) can be converted to a non-operating door handle assembly 150 (FIG. 2) by replacing the drive assembly 130 with a dummy lug 60. Conversely, the non-operating door handle assembly can be converted to an operating door handle assembly by replacing the dummy lug with a drive assembly. This interchangeability can be valuable in the case of a double door where the door handles have been ordered in the wrong configuration. By disassembling both the operating and non-operating door handle system, the dummy lug and drive assembly can be exchanged to convert the functional configuration of the door handle systems without requiring any new or additional parts to be ordered from the manufacturer or supplier. Being able to convert door handle systems from operating to non-operating is valuable to a manufacturer because it reduces the number of returns for incorrect orders. Convertibility is also valuable to the customer for two reasons: i) the customer can choose whether the door handle is operable or non-operable and ii) the customer can choose the handing for the door handle system.

Optionally, the door handle system may be shipped with both a dummy lug and a drive assembly. During installation, either the dummy lug or drive assembly may be installed, depending on whether an operating or non-operating configuration is desired.

Figure 3:
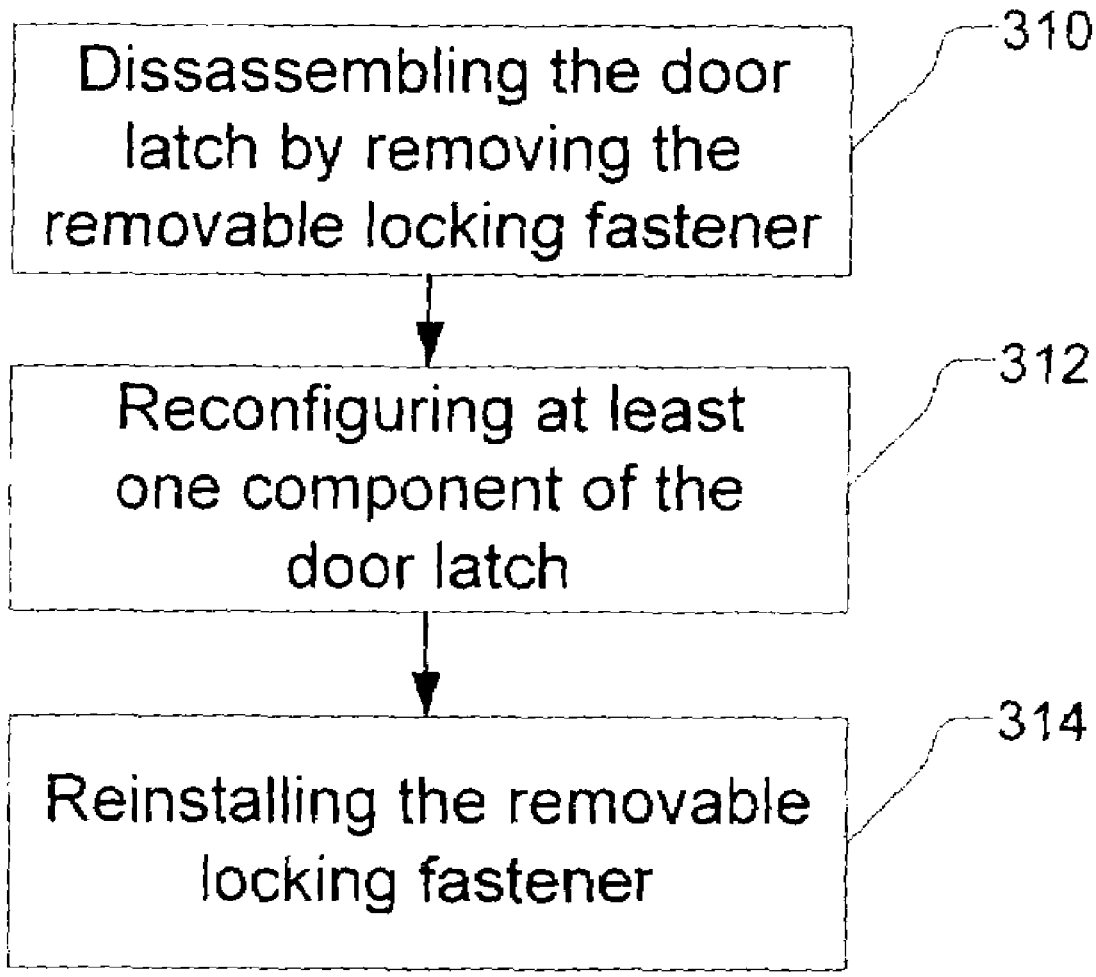
FIG. 3 is a flow chart of a method of converting a functional configuration of a door handle system having a removable locking fastener.

Reconfiguration of the functional configuration of a door handle system may be performed using the method shown in FIG. 3. The first operation 310 includes disassembling the door handle system by removing the removable locking fastener from the handle. The second operation 312 includes reconfiguring at least one component of the door handle system. For example, this reconfiguring operation can include any one or more of the following operations:

- converting the handing by replacing the handle with a different handle or switching handles;
- converting levers for knobs or vice versa;
- converting the system to split function operation whereby one side of the door can be a dummy function (non-operating) and opposite side can be active (operating);
- converting the orientation by rotating the receiver plate on the door and reorienting the drive assembly to change the orientation of the door handle system (e.g. handle-high to handle-low);
- converting the door handle operation from operating to non-operating by replacing a drive assembly with a dummy lug;
- converting the drive washer configuration to vary clocking, handle travel, direction of handle travel, and limit the rotation of the handle in providing overdrive protection so the lock and/or latch cannot be damaged;
- change from handle-down operation to handle-up operation or a combination of both;
- converting the door handle operation from non-operating to operating by replacing a dummy lug with a drive assembly.

Finally, the third operation 314 includes reassembling the door handle system by reinstalling the removable locking fastener onto the door handle system.

Although the present invention can be made of many types of materials such as iron, brass, aluminum, tin, or metal alloys, there are some generally useful materials which will now be described. To prevent corrosion of the door handle system, components may be manufactured of a corrosion resistant material. Particularly corrosion resistant and attractive materials include bronze and stainless steel. For example, external, visible components, such as the handle and receiver plate can be made of non-corrosive bronze and the internal components can be made of stainless steel.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments of the invention. It will be apparent to those of ordinary skill in the art that numerous modifications can be made without departing from the principles and concepts of the invention as set forth in the claims.

What is claimed is:

1. A convertible door handle system, comprising:

a receiver plate having a receiver opening, a receiver recess, and a receiver index, said receiver recess located around said receiver opening and said receiver index located in said receiver recess;

a handle having a handle shaft and a handle index, said handle index located on said handle shaft and said handle shaft extending through said receiver opening;

a drive assembly including a drive member directly connected to said handle index and positioned within said receiver recess to interact with said receiver index to rotatably couple said handle with said receiver plate, said drive assembly removable to reconfigure the functional operation of said door handle system; and a removable locking fastener coupled to said handle shaft to secure said handle and said drive assembly within said receiver plate, wherein said handle index further comprises a groove in said handle shaft, and wherein one of said removable locking fastener and said drive assembly further comprises a nub, said nub configured to engage said groove in said handle shaft.

2. The convertible door handle system of claim 1, wherein the removable locking fastener comprises:

a nut threaded onto external threads of the handle shaft; and a retainer adjacent to said nut and configured to engage said handle index, said retainer having a retainer tab removably extended over said nut to engage the nut and thereby prevent said nut from turning relative to said handle, said retainer tab repositionable out of engagement with said nut to allow said nut to turn independently.

3. The convertible door handle system of claim 1, wherein said receiver index further comprises a nub extending into said receiver recess.

4. The convertible door handle system of claim 1, wherein said receiver index further comprises at least two reference point defining structures symmetrically disposed about said receiver recess.

5. The convertible door handle system of claim 1, wherein said drive assembly further comprises at least two reference point defining structures symmetrically disposed about a central axis of said drive assembly, configured to engage said handle index.

6. The convertible door handle system of claim 1, wherein said drive assembly further comprises at least one reference point defining structure configured to interact with said receiver index to prevent overdrive of said handle.

7. The convertible door handle system of claim 1, wherein said drive assembly further comprises at least two reference point defining structures symmetrically disposed about a central axis of said drive assembly and configured to interact with said receiver index to prevent overdrive of said handle.

8. The convertible door handle system of claim 1, further comprising a removable bushing seated within said receiver opening, said removable bushing being configured to receive said handle shaft.

9. The convertible door handle system of claim 1, further comprising a dummy lug configured to engage the receiver index and the handle index to secure the handle in a fixed position to convert the door handle system from operating to non-operating.

10. The convertible door handle system of claim 1, wherein the drive assembly comprises:

a drive washer configured to receive the handle shaft and engage the handle index, the drive washer having a drive washer tab; and a coil spring having a first ear and a second ear configured so that the first ear bears against the drive washer tab and the second ear interacts with the receiver index to apply restoring force to the handle to return the handle to a desired rotational position.

11. The convertible door handle system of claim 10, wherein the coil spring is sized to counterbalance an off-center weight of the door handle to eliminate handle sag.

12. The convertible door handle system of claim 10, wherein the coil spring comprises a double coil.

13. The convertible door handle system of claim 1, wherein said receiver plate and said handle are manufactured of a corrosion resistant material.

14. The convertible door handle system of claim 13, wherein said corrosion resistant material is selected from the group consisting of bronze and stainless steel.

15. A convertible door handle system, comprising:

a receiver plate having a receiver opening, a receiver recess, and a receiver index, said receiver recess located around said receiver opening and said receiver index located in said receiver recess, further comprising a removable bushing seated within said receiver opening, said removable bushing being configured to receive said handle shaft;

a handle having a handle shaft and a handle index, said handle index located on said handle shaft and said handle shaft extending through said receiver opening;

a drive assembly including a drive member directly connected to said handle index and positioned within said receiver recess to interact with said receiver index to rotatably couple said handle with said receiver plate, said drive assembly removable to reconfigure the functional operation of said door handle system; and a removable locking fastener coupled to said handle shaft to secure said handle and said drive assembly within said receiver plate.

16. The convertible door handle system of claim 15, wherein said handle index further comprises a groove in said handle shaft.

17. The convertible door handle system of claim 16, wherein said removable locking fastener further comprises a nub configured to engage said groove in said handle shaft.

18. The convertible door handle system of claim 16, wherein said drive assembly further comprises a nub configured to engage said groove in said handle shaft.

19. The convertible door handle system of claim 15, wherein said receiver index further comprises a nub extending into said receiver recess.

20. The convertible door handle system of claim 15, wherein said receiver index further comprises at least two reference point defining structures symmetrically disposed about said receiver recess.

21. The convertible door handle system of claim 15, wherein said drive assembly further comprises at least two reference point defining structures symmetrically disposed about a central axis of said drive assembly, configured to engage said handle index.

22. The convertible door handle system of claim 15, wherein said drive assembly further comprises at least one reference point defining structure configured to interact with said receiver index to prevent overdrive of said handle.

23. The convertible door handle system of claim 15, wherein said drive assembly further comprises at least two reference point defining structures symmetrically disposed about a central axis of said drive assembly and configured to interact with said receiver index to prevent overdrive of said handle.

24. The convertible door handle system of claim 15, further comprising a dummy lug configured to engage the receiver index and the handle index to secure the handle in a fixed position to convert the door handle system from operating to non-operating.

25. The convertible door handle system of claim 15, wherein the drive assembly comprises:

a drive washer configured to receive the handle shaft and engage the handle index, the drive washer having a drive washer tab; and a coil spring having a first ear and a second ear configured so that the first ear bears against the drive washer tab and the second ear interacts with the receiver index to apply restoring force to the handle to return the handle to a desired rotational position.

26. The convertible door handle system of claim 25, wherein the coil spring is sized to counterbalance an off-center weight of the door handle to eliminate handle sag.

27. The convertible door handle system of claim 25, wherein the coil spring comprises a double coil.

28. The convertible door handle system of claim 15, wherein said receiver plate and said handle are manufactured of a corrosion resistant material.

29. The convertible door handle system of claim 28, wherein said corrosion resistant material is selected from the group consisting of bronze and stainless steel.

30. The convertible door handle system of claim 15, wherein the removable locking fastener comprises:

a nut threaded onto external threads of the handle shaft; and a retainer adjacent to said nut and configured to engage said handle index, said retainer having a retainer tab removably extended over said nut to engage the nut and thereby prevent said nut from turning relative to said handle, said retainer tab repositionable out of engagement with said nut to allow said nut to turn independently.

* * * * *